US007951022B2

(12) United States Patent
Yearick

(10) Patent No.: US 7,951,022 B2
(45) **Date of Patent: *May 31, 2011**

(54) RACKET AND PROJECTILE GAME

(75) Inventor: David J. Yearick, Taylors, SC (US)

(73) Assignee: David J. Yearick, Taylors, SC (US)

( * ) Notice: Subject to any disclaimer, the term of this patent is extended or adjusted under 35 U.S.C. 154(b) by 106 days.

This patent is subject to a terminal disclaimer.

(21) Appl. No.: 12/425,688

(22) Filed: Apr. 17, 2009

(65) Prior Publication Data

US 2009/0203475 A1 Aug. 13, 2009

Related U.S. Application Data

(63) Continuation-in-part of application No. PCT/US2007/015483, filed on Jul. 3, 2007.

(51) Int. Cl.
*A63B 65/12* (2006.01)
*A63B 59/02* (2006.01)

(52) U.S. Cl. ..... 473/515; D21/301; D21/305; 473/505

(58) Field of Classification Search ..... 473/505, 473/511, 513, 515; D8/363; D22/106; 43/11; D21/301, 302, 304, 305, 306; 273/412, 348.2; 16/87.2; 124/5, 27, 16

See application file for complete search history.

(56) References Cited

U.S. PATENT DOCUMENTS

| | | | | | |
|---|---|---|---|---|---|
| 534,996 | A * | 3/1895 | Cundy | 473/511 |
| 866,614 | A * | 9/1907 | Becker | 473/578 |
| 876,324 | A * | 1/1908 | Brucker | 124/16 |
| 922,432 | A * | 5/1909 | Jirotka | 473/514 |
| 2,604,715 | A * | 7/1952 | Brown, Jr. | 43/11 |
| 2,805,460 | A * | 9/1957 | Gries | 24/698.1 |
| 3,077,237 | A * | 2/1963 | Nakayama | 177/245 |
| 3,764,141 | A * | 10/1973 | Robertson et al. | 273/412 |
| 4,145,050 | A * | 3/1979 | Sullivan et al. | 473/509 |
| 5,174,580 | A * | 12/1992 | Pratt | 473/513 |
| 5,232,226 | A * | 8/1993 | Glickson | 473/510 |
| 7,476,166 | B2 * | 1/2009 | Yearick | 473/505 |
| 2005/0188970 | A1 * | 9/2005 | Cuisinier | 124/5 |

* cited by examiner

*Primary Examiner* — Gene Kim
*Assistant Examiner* — M Chambers
(74) *Attorney, Agent, or Firm* — Harness, Dickey & Pierce, P.L.C.

(57) ABSTRACT

A game includes a pair of rackets for propelling and catching a projectile. Each racket includes a rim for supporting a net between its inner periphery and one of a hook and a loop on an outer periphery. The projectile includes a generally circular member and an elastic band. The band carries the other of the hook and loop which cooperates with the racket for propelling the projectile. The racket may be positioned to catch the propelled projectile in the net.

17 Claims, 4 Drawing Sheets

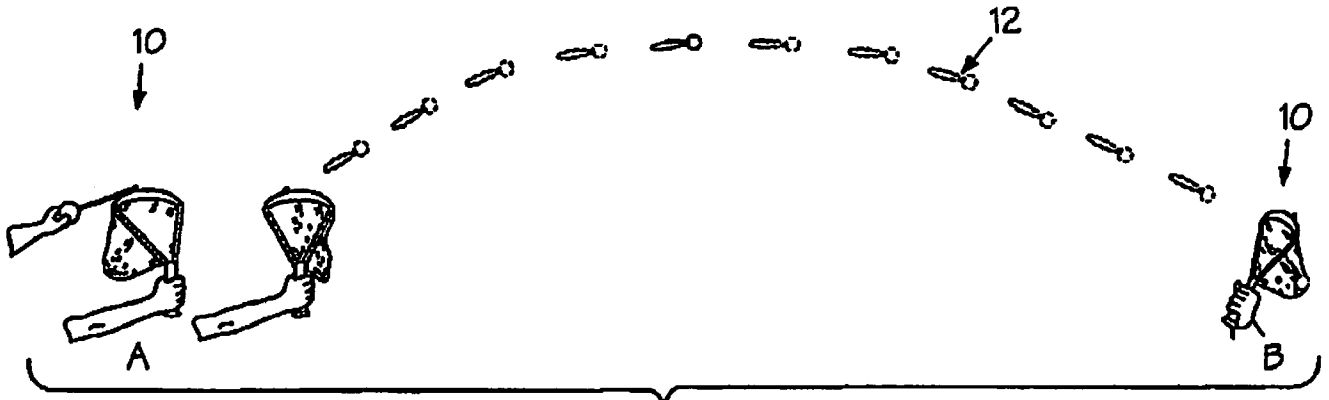
Fig. 2
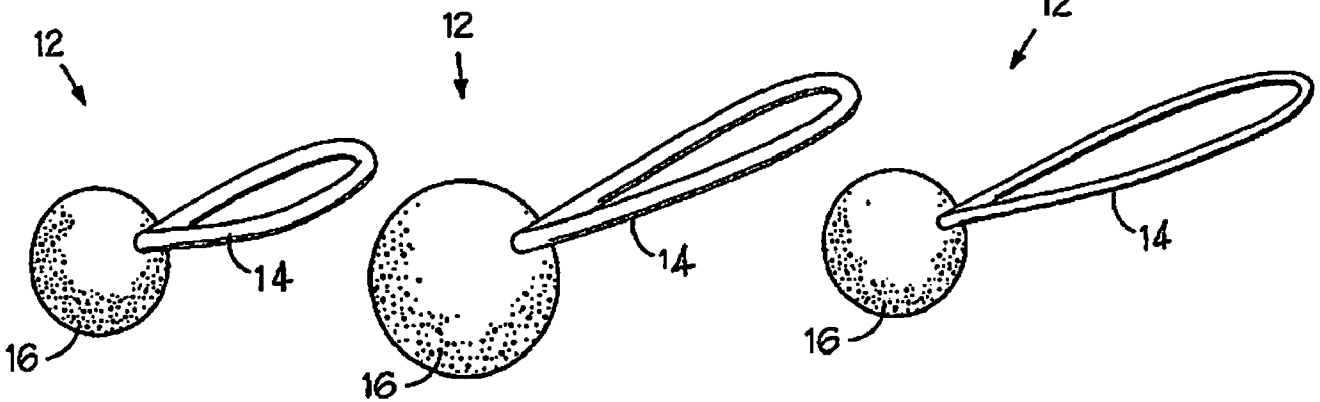
Fig. 3A
Fig. 3B
Fig. 3C

RACKET AND PROJECTILE GAME

CROSS-REFERENCE TO RELATED APPLICATION

This application is a continuation-in-part of PCT/US2007/015483 filed 3 Jul. 2007 which claims priority to U.S. patent application Ser. No. 11/583,317, filed 19 Oct. 2006 (now U.S. Pat. No. 7,476,166). The entire disclosure of the above application is incorporated herein by reference.

FIELD

The present disclosure relates to a game including a racket and a projectile.

BACKGROUND

This section provides background information related to the present disclosure which is not necessarily prior art.

The present teachings are directed to a game of pitch and catch between at least a pair of players. The game may be for use with younger children, generally between the ages of 10 and 20. However, younger or older persons will also find the game appealing.

In general, games of pitch and catch require a degree of skill and athletic ability to both cause the ball or projectile to be put into flight and to catch the projectile when in flight. The instant invention has as its primary object to assist and make easier the accomplishment of both of these functions while providing amusement for the players.

SUMMARY

This section provides a general summary of the disclosure, and is not a comprehensive disclosure of its full scope or all of its features.

The instant game of pitch and catch includes a pair of rackets for projecting and catching a projectile. The racket includes a generally oval or circular shaped rim to which a net is attached to extend within the inner periphery of the rim to form a pocket. A handle is secured with the rim to extend outwardly from its outer periphery. A hook is secured with the outer periphery of the rim in a position generally opposed the handle.

In use, the handle is adapted to be engaged by a player for moving the racket to catch the projectile in flight and to position the hook for engagement with the projectile for propelling it into flight.

The rim may be comprised wholly or partially of semi-rigid molded polymeric material. If only partially of molded polymeric material, the remaining rim portion is comprised of resilient tubing. The tubing may be formed of resilient polymeric material. A brace may be secured over a portion of the rim to include the tubing in a position generally opposite the handle. The brace is generally U-shaped to resiliently engage with the rim and that portion of the net engaged with the rim. The hook may be carried by the brace or the tubing along an axis which extends generally parallel with the rim.

The projectile includes a body or ball and a resilient sling or elastic filament which is connected with the body. The body is generally round and formed of a resilient material or resilient filament. The sling comprises a resilient filament or elongated elastic member formed into a loop. In use, the loop is engaged with the hook, the body is drawn away from the hook causing the filament to be stretched. The body is released causing the filament to propel the projectile.

A game for pitch and catch including first and second rackets and a projectile. Each racket includes a generally circular rim connected with a generally linear handle and a net connected with said rim forming a pocket within the inner periphery of the rim. A hook is connected with the outer periphery of said rim generally opposite the handle. The projectile includes a generally circular mass or ball connected with an elongated loop of elastic material for propelling the projectile.

In use, players are in spaced positions and each carries a racket. The rackets are controlled to position the pocket to catch the projectile when in flight and to anchor the loop with the hook so that the projectile, when moved away from the hook, stretches the loop and when released allows the loop to recoil and propel the projectile into flight. The projectile is propelled and caught in repetitive back and forth motions between the players.

According to one particular aspect, the present teachings provided a projecting and catching game including a racket and a projectile. The racket has a rim carrying a net. The net forms a pocket. The racket has a handle extending from the rim. The projectile includes a body and a resilient filament extending from the body. A first cooperating element is carried by the rim in a position generally opposed the handle. A second cooperating element is carried by the resilient filament. The first cooperating element is one of a hook and a loop and the second cooperating element is the other of the hook and the loop. The handle is adapted to be engaged by a player for moving the racket to catch the projectile in flight and to position the first cooperating element for engagement with the second cooperating element to stretch the filament and propel the projectile into flight.

According to another particular aspect, the present teachings provide a game for pitch and catch includes first and second rackets and a projectile. Each racket includes a rim connected with a handle and a net. The net is connected with the rim and forms a pocket within an inner periphery of the rim. A first cooperating element connected with the outer periphery of the rim generally opposed the handle. The projectile includes a generally circular mass connected with an elongated length of elastic material carrying a second cooperating element for propelling the projectile. Each player, in spaced positions, acts with repetitive actions to control one of the first and second rackets into position to catch in the pocket the projectile when in flight, to grip the caught projectile, to secure the first and second cooperating elements, to move the projectile away from the first cooperating member stretching the length of elastic material and to release the projectile allowing the length of elastic material to retract propelling the projectile into flight between the players.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 2 is a schematic illustration of the manner in which the projectile is put into flight (i.e., pitched) and caught.

FIG. 3A is a perspective view of a first projectile or ball for use with the game.

FIG. 3B is a perspective view of a second projectile or ball for use with the game.

FIG. 3C is a perspective view of a third projectile or ball for use with the game.

Corresponding reference numerals indicate corresponding parts throughout the several views of the drawings.

DESCRIPTION OF VARIOUS ASPECTS

Example embodiments will now be described more fully with reference to the accompanying drawings.

Figure 1:
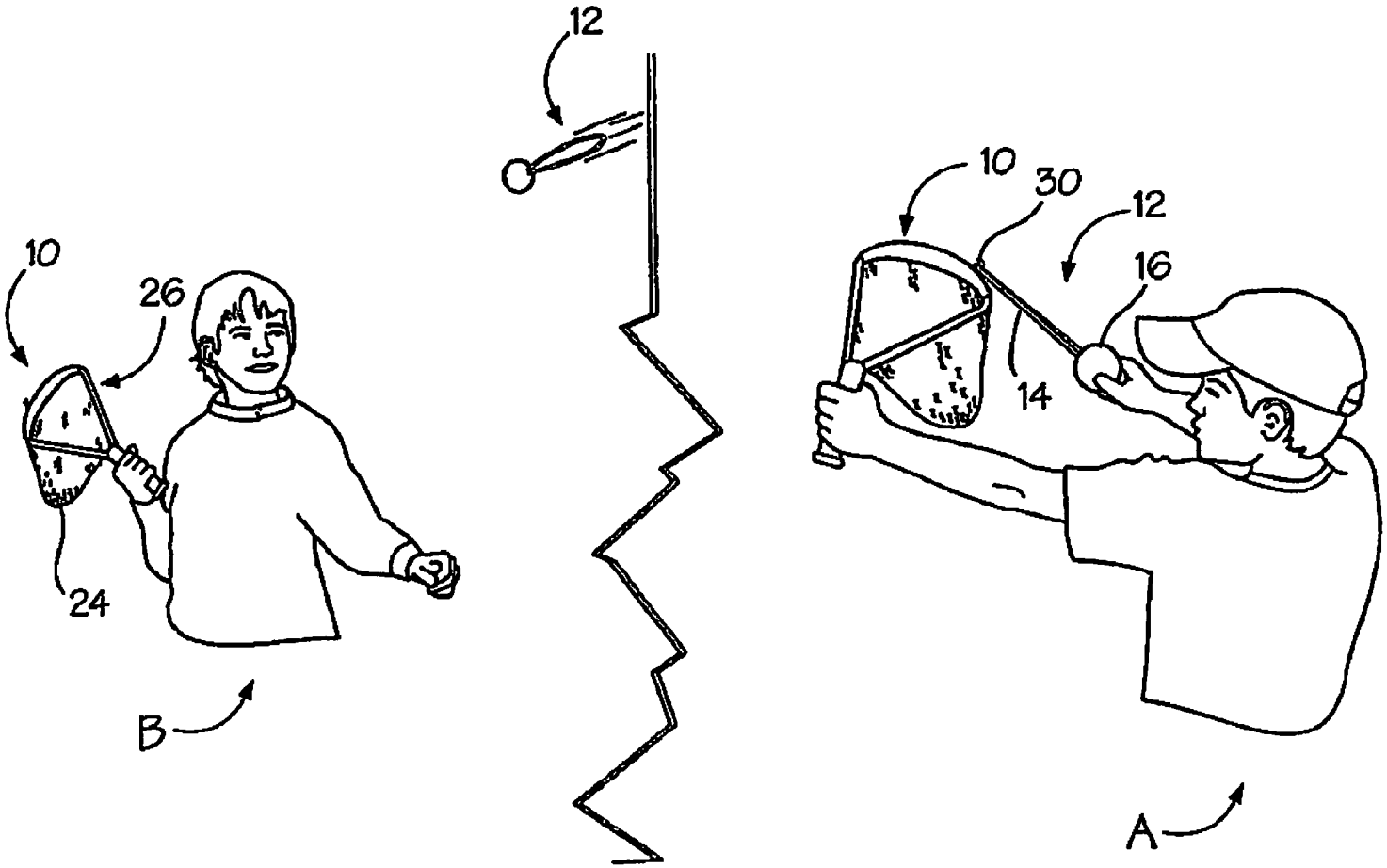
FIG. 1 is a schematic illustration of the pitch and catch game of the present teachings.

With general reference to FIGS. 1-4 and particular reference to FIGS. 1 and 2, a general schematic of the instant game as played is provided. Generally, a pair of players A and B are shown. Each player is holding in one hand a racket 10. Player A is shown with racket 10 in a generally extended and elevated position with projectile 12 connected to and being drawn away from the racket 10. The racket 10 may carry one of a hook 30 and a loop. An elastic cord or filament 14, arranged in the form of the other of the hook 30 and the loop, is connected with mass or ball 16 and is shown in an extended position. This extended position is much like a slingshot in the drawn position with mass 16 being the propelled object. In the embodiment illustrated, the racket 10 carries the hook 30 and the cord 14 carries the loop.

Upon releases of mass 16, the stretched filament 14 retracts to project the projectile toward player B. Player B also holds a racket 10 in an elevated position generally facing player A and projectile 12 which is now in flight and moving toward player B. When the projectile arrives, player B catches it in the net or webbing of the racket as illustrated in FIG. 2. The process is repeated by player B with projectile 12 is propelled back toward player A. The game is played with two or more players. When more than two players are involved, more than one projectile may or may not be used.

Turning now to FIGS. 3A, B and C, projectile 12 comprises a generally circular mass or ball 16 which is connected with an elastic cord or filament 14. Ball 16 is preferably elastic and formed to a diameter of anywhere between 2" and 6". Ball 16 may be formed of rubber or an elastic, generally spongy polymer. It may be hollow or of an even consistency throughout.

Connected with ball 16 is a sling in the form of an elastic filament or cord 14 which is generally in the form of the loop or may carry the loop at an end. Cord 14 may comprise a single filament or a plurality of filaments provided sufficient elasticity is provided to allow the cord to be extended to substantially double its length and to contract with sufficient force to propel the ball between approximately 5 yards and 50 yards. The cord preferably is a filament formed of rubber or of a suitable polymer such as polyurethane or polyvinyl chloride. Other suitably elastic materials may be utilized.

Cord 14 is attached to ball 16 in any known manner secured to ball 16. Preferably, cord 14 is in an unyielding manner. In certain embodiments, cord 14 may range from between 4" to 18" in length and in diameter from ⅛" to ¼", depending upon the weight of the ball and the distance desired propelled.

Figure 4:
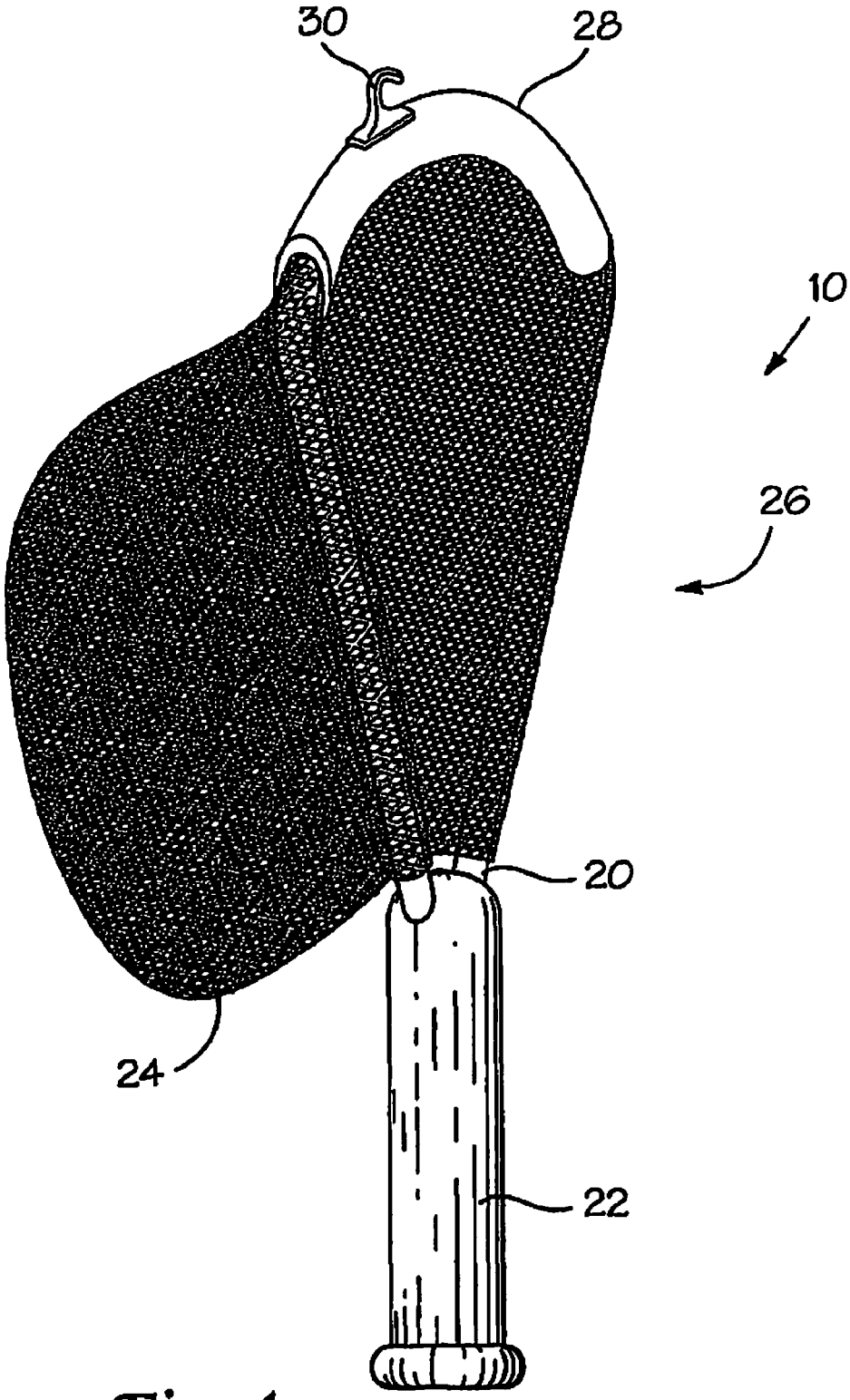
FIG. 4 is a perspective view of the racquet for use with the game.

Turning now to FIG. 4, racket 10 is shown in more detail. Racket 10 may include rim 20 which is generally circular or an oval shape and which connects with handle 22 along its outer periphery. Alternatively, handle 22 may be of any other suitable shape. Handle 22 extends along an axis generally parallel with rim 20.

Net 24 may be engaged about rim 20 and may extend to one side thereof forming pocket 26 between the inner periphery of rim 20. As illustrated, the pocket may be formed to be about 7" deep. The pocket size and depth may be altered as desired. It is noted that the net may be molded onto the rim or attached with fasteners as desired.

If desired, a generally U-shaped brace 28 may be secured over a portion of the periphery of rim 20 and that portion of net 24 engaged with the rim. Brace 28 may be applied to rim 20 generally opposite the position of handle 22. Brace 28 may be formed of polymeric material which resiliently engages over rim 20. Brace 28 acts to stabilize the portion of the rim most distant from the handle 22.

Secured to the outer surface of brace 28 is hook 30. Hook 30 is preferably C-shaped but it could be no more than a straight peg. The hook is generally arranged in any of several positions on the outer periphery of rim 20 generally opposite handle 22.

It is noted that the use of brace 28 is not necessary. When the brace is deemed to be unnecessary, hook 28 may be connected with the outer periphery of rim 20 in generally the same position relative to handle 22.

Racket 10 may be molded of a generally semi-rigid polymeric material to comprise a generally circular or oval shaped rim with a handle extending from its outer edge. In this form, hook 30 may be formed with the rim in a selected position opposite the handle. In another arrangement, brace 28, carrying hook 30, may be secured over the rim 20 generally opposite the handle as earlier described. Alternatively, the racket may be comprised of a molded generally Y-shaped section with the molded portion of the rim in this arrangement forming a V. Tubing of synthetic material and of generally the same diameter is engaged over the outer ends of the V-shaped extensions to form a continuous rim which is generally circular or oval in shape. Another arrangement could have the entire racket formed of molded polymeric material. Brace 28 carrying hook 30 may be secured over the tubing as earlier described or hook 30 may simply be secured with the tubing or that portion of the rim opposite the handle.

In order to propel projectile 10, cord 14 is engaged over hook 30 with ball 16 being held by the player. The ball is drawn away from the hook causing cord 14 to be stretched into a desired stretched condition. The ball is released allowing the elongated cord to retract toward the hook propelling the ball in the direction in which the racket is pointed. The elastic strength and length of the cord may be varied as may the size and weight of the ball depending upon the desired results.

Figure 5:
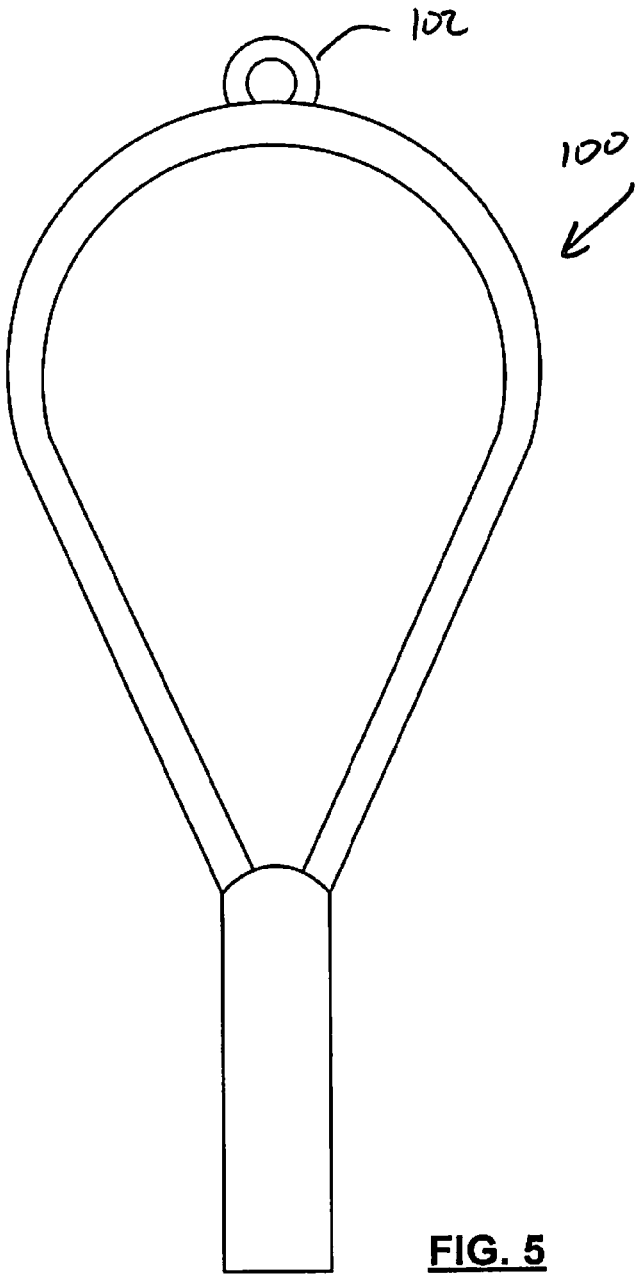
FIG. 5 is a simplified view of an alternate racquet.

Turning to FIG. 5, a simplified view of an alternative racket 100 is illustrated. The racket 100 will be understood to be identical to the racket 10 to the extent not illustrated or described. The racket 100 differs in that the rim carries a first cooperating element in the form of a loop 102 rather than a hook.

Figure 6:
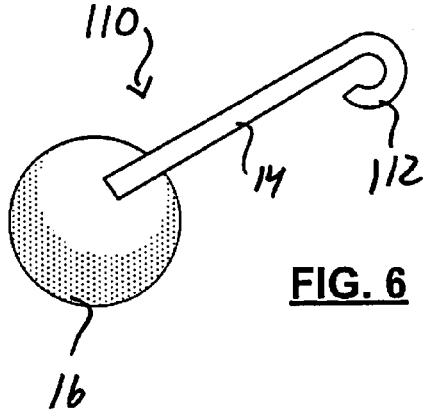
FIG. 6 is a view of an alternative projectile for use with the racquet of FIG. 5.

Turning to FIG. 6, an alternative projectile 110 for use with the racket 100 of FIG. 5 is illustrated. The projectile 110 is similar to the projectile 12 except that the projectile 110 incorporates a second cooperating element in the form of a hook 112 for cooperating with the loop 102. The hook 112 may be carried at the end of the filament 14.

The game improves the dexterity and hand/eye coordination of the players while providing enjoyment, relaxation and fellowship.

While various embodiments of the present teachings have been described using specific terms, such description is for illustrative purposes only, and it is to be understood that changes and variations may be made without departing from the spirit or scope of the following claims. The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A projecting and catching game comprising:

a racket having a rim carrying a net, the net forming a pocket, the racket having a handle extending from the rim;

a projectile including a body and a resilient filament extending from the body;

a first cooperating element carried by the rim in a position generally opposed the handle; and a second cooperating element carried by the resilient filament;

wherein the first cooperating element is one of a hook and a loop and the second cooperating element is the other of the hook and the loop;

wherein the handle is adapted to be engaged by a player for moving the racket to catch the projectile in flight and to position the first cooperating element for engagement with the second cooperating element to stretch the filament and propel the projectile into flight.

2. The game of claim 1, wherein the rim includes resilient tubing.

3. The game of claim 2, wherein the tubing is formed of resilient polymeric material.

4. The game of claim 1, wherein the rim is molded of polymeric material.

5. The game of claim 1, further including a brace secured over a portion of the rim in a position generally opposite the handle.

6. The game of claim 5, wherein the hook is carried by the brace.

7. The game of claim 1, wherein the racket comprises a unitary unit molded of semi-rigid material.

8. The game of claim 1, wherein the handle is generally circular and formed along an axis.

9. The game of claim 1, wherein the first cooperating element is the hook and the second cooperating element is the loop.

10. The game of claim 1, wherein the first cooperating element is the loop and the second cooperating element is the hook.

11. A game for pitch and catch including:

first and second rackets and a projectile, wherein each racket includes a rim connected with a handle; and a net connected with the rim forming a pocket within an inner periphery of the rim and a first cooperating element connected with the outer periphery of the rim generally opposed the handle;

the projectile includes a generally circular mass connected with an elongated length of elastic material carrying a second cooperating element for propelling the projectile, wherein each player, in spaced positions, acts with repetitive actions to control one of the first and second rackets into position to catch in the pocket the projectile when in flight, to grip the caught projectile, to secure the first and second cooperating elements, to move the projectile away from the first cooperating member stretching the length of elastic material and to release the projectile allowing the length of elastic material to retract propelling the projectile into flight between the players.

12. The game of claim 11, wherein the circular mass is resilient and formed to have a diameter of between 1" and 2".

13. The game of claim 11, wherein the loop is formed of a resilient polymeric filament of between 4" and 8".

14. The game of claim 11, wherein the racket comprises a unitary molded member including the rim, handle and hook.

15. The game of claim 11, wherein the first cooperating element is one of a hook and a loop and the second cooperating element is the other of the hook and the loop.

16. The game of claim 11, wherein the first cooperating element is the hook and the second cooperating element is the loop.

17. The game of claim 11, wherein the first cooperating element is the loop and the second cooperating element is the hook.

* * * * *